United States Patent [19]

Cipriani

[11] Patent Number: 4,911,055

[45] Date of Patent: Mar. 27, 1990

[54] INCREASED TORQUE BRIDGE FOR GUITARS

[76] Inventor: Thomas J. Cipriani, 640 E. Park Ave., Long Beach, N.Y. 11561

[21] Appl. No.: 346,145

[22] Filed: May 1, 1989

Related U.S. Application Data

[63] Continuation of Ser. No. 39,941, Apr. 20, 1987, abandoned.

[51] Int. Cl.[4] ..... G10D 3/04

[52] U.S. Cl. ..... 84/299; 84/267; 84/312 R

[58] Field of Search ..... 84/267, 298, 299, 307, 84/312

[56] References Cited

U.S. PATENT DOCUMENTS

| | | | |
|---|---|---|---|
| 536,846 | 4/1895 | Bates | 84/298 |
| 621,700 | 3/1899 | Olson | 84/298 |
| 976,428 | 11/1910 | Benson et al. | 84/298 |
| 1,764,679 | 6/1930 | Gast | 84/298 |
| 2,491,788 | 12/1949 | Widowson | 84/298 |
| 4,178,827 | 12/1979 | Mallory | 84/291 |
| 4,425,832 | 1/1984 | Peavey | 84/298 |
| 4,464,970 | 8/1984 | Mischakoff | 84/298 |
| 4,768,414 | 9/1988 | Wheelwright | 84/298 |

FOREIGN PATENT DOCUMENTS

| | | | |
|---|---|---|---|
| 2450010 | 4/1976 | Fed. Rep. of Germany | 84/307 |

*Primary Examiner*—Lawrence R. Franklin
*Attorney, Agent, or Firm*—Ladas & Parry

[57] ABSTRACT

Bridge for improving volume, power and sustaining quality in a stringed musical instrument of the type having a hollow body over which are stretched substantially parallel strings, each string being stretched. The string height is raised over the sound board. One end of a string may be anchored to a crossbrace on the underside of the sound board so as to directly vibrate this sound board. It also incorporates a means an adjustment mechanism for string length fine tuning. The result is increased sound, volume and resonance persistence which is without distortion that may result in increased amplification when applied to guitars or other stringed instruments.

14 Claims, 6 Drawing Sheets

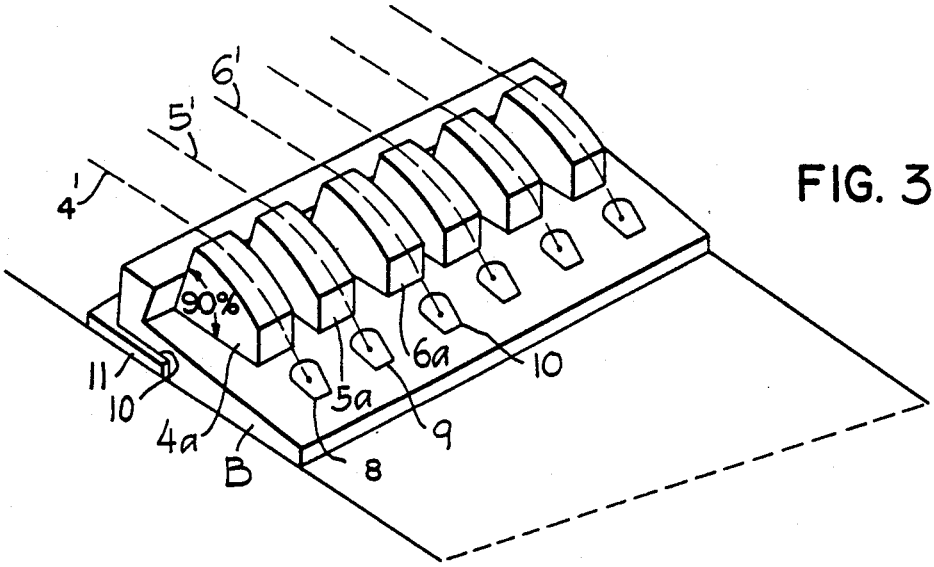
FIG. 3
FIG. 4
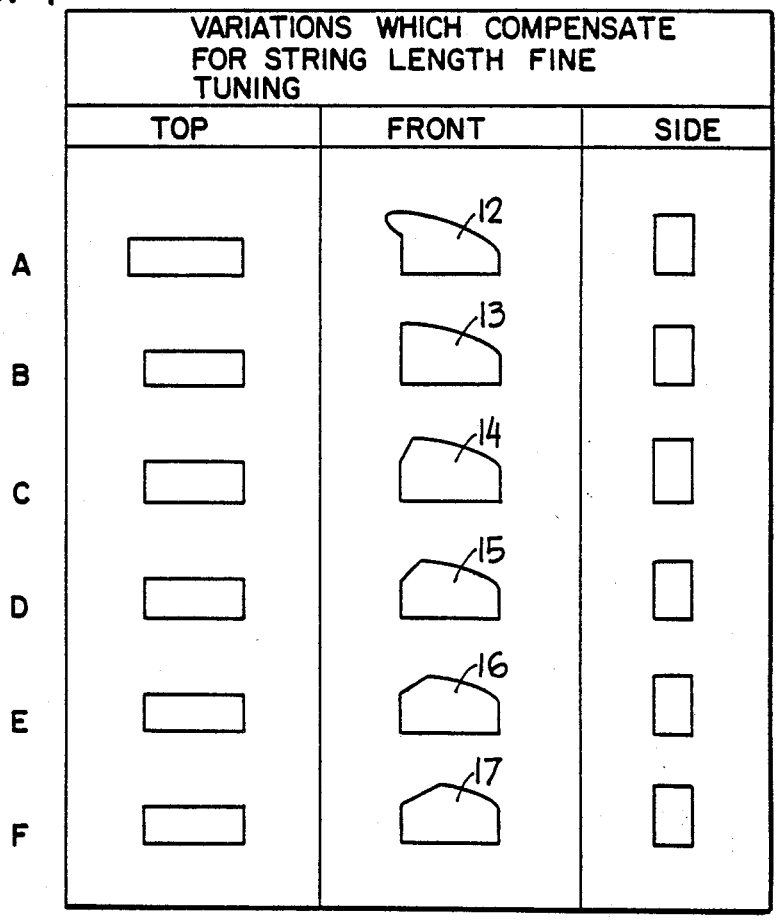

FIG. 4B
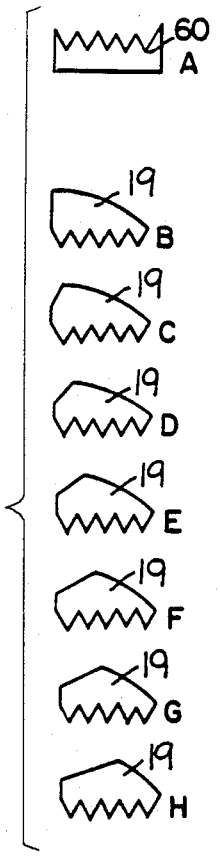
FIG. 5
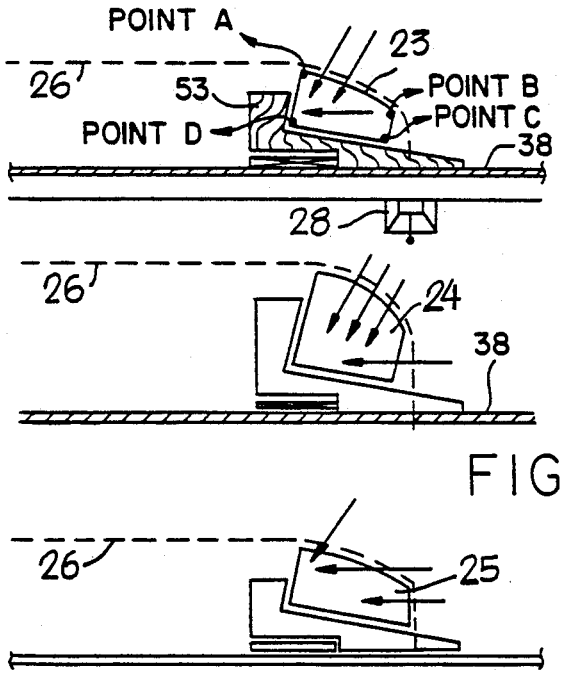
FIG. 5A
FIG. 5B
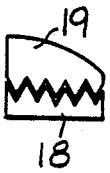
FIG. 4A

INCREASED TORQUE BRIDGE FOR GUITARS

CROSS RELATED APPLICATION

This application is a continuation of Ser. No. 039,941 filed Apr. 20, 1987 now abandoned.

FIELD OF THE INVENTION

This invention relates to tension bridge for guitars and more particularly, to tension bridges to increase volume, power and sustaining quality of the guitar.

PRIOR ART

Prior Art is shown in the following patents: 621,700, 4,464,970, 4,506,585, 4,311,078, 4,436,015, 4,538,498, 4,320,685, 4,497,236.

None of the above patents discloses the improvement of the invention which increase the volume, power and sustaining quality of the music.

BACKGROUND OF THE INVENTION

The standard acoustical guitar has not changed dramatically for perhaps a century. Three of the main ingredients that make one guitar superior over another are, volume, sustain and balance.

There are two main types of acoustical guitars, classical or nylon string and steel string, steel string having two main types, flat top and arched top.

This bridge invention may be used to improve all of these guitars. To help in understanding this invention, knowledge of the background of the classical guitar is helpful.

The classical guitar reached one of its evolutionary plateaus with the designs of the designer Antonio Torres.

Torres established the string length at 25 9/16". That is to say the point of contact from the edge of the nut to the tip of the bridge. The 25 9/16" length has proven over the years to be the most musically balanced, and mellow of all string lengths.

It is known to those skilled in the guitar art that there are two types of string tuning. One type of tuning is referred to as pitch, or fine tuning, which is accomplished by increasing or decreasing the tension in a given string by means of tuning keys or the like, thereby raising or lowering, respectively, the pitch of the string. The other type of string tuning is referred to as harmonic or length tuning, which is accomplished by altering the distance between the points at which a given string contacts the bridge and nut elements of the instrument.

Many prominent designers in their demand to come up with a louder guitar have compromised the 25 9/16" length in order to have a louder guitar. To understand this more completely, see the following formula:

Longer string length = more tension on bridge = more volume.

The main purpose of the bridge is to allow the string length to remain at 25 9/16" yet increase volume levels equal to or surpassing that of a guitar with a longer string length. A longer string length may still be used with the bridge of the invention.

THE INVENTION

According to the invention by raising the strings above the sound board considerably more than in conventional guitars, one is able to obtain the additional volume, power and sustaining qualities. The invention comprises a new bridge piece having a first base member mounted on the sounding board of the guitar body. A second enlarged saddle member is on the first member. The first member has a transverse notch on its lower surface and a third wedge member is mounted in said notch.

OBJECTS OF THE INVENTION

A principal object of the invention is to provide new and improved tension bridges for guitars.

Another object of the invention is to provide new and improved tension bridges for guitars which provide additional volume, power and sustaining quality.

Another object of the invention is to provide new and improved stringed musical instruments of the type having a hollow body over which are stretched substantially parallel strings, each string being stretched between a tuning key and a bridge piece, the bridge piece comprising: a first base member mounted on the top of the sound board of the body, a second extended saddle member mounted on the first member, the first member having a transverse notch in its lower forward surface and a third wedge member mounted in said notch, whereby this embodiment produces superior forces and increased tensions and torque and means for string length fine tuning.

BRIEF DESCRIPTION OF THE DRAWINGS

These and other objects of the invention will be apparent from the following specification and drawings of which:

FIG. 3 is a perspective view of another embodiment of a bridge.

FIG. 4 shows orthographic views of bridge shapes serving as means for string length fine tuning.

FIG. 4A & 4B are variations of the interconnections between the base and top saddle pieces.

FIGS. 5, 5A & 5B are side views illustrating the principles of the invention.

DETAILED DESCRIPTION OF PREFERRED EMBODIMENTS

Figure 1:
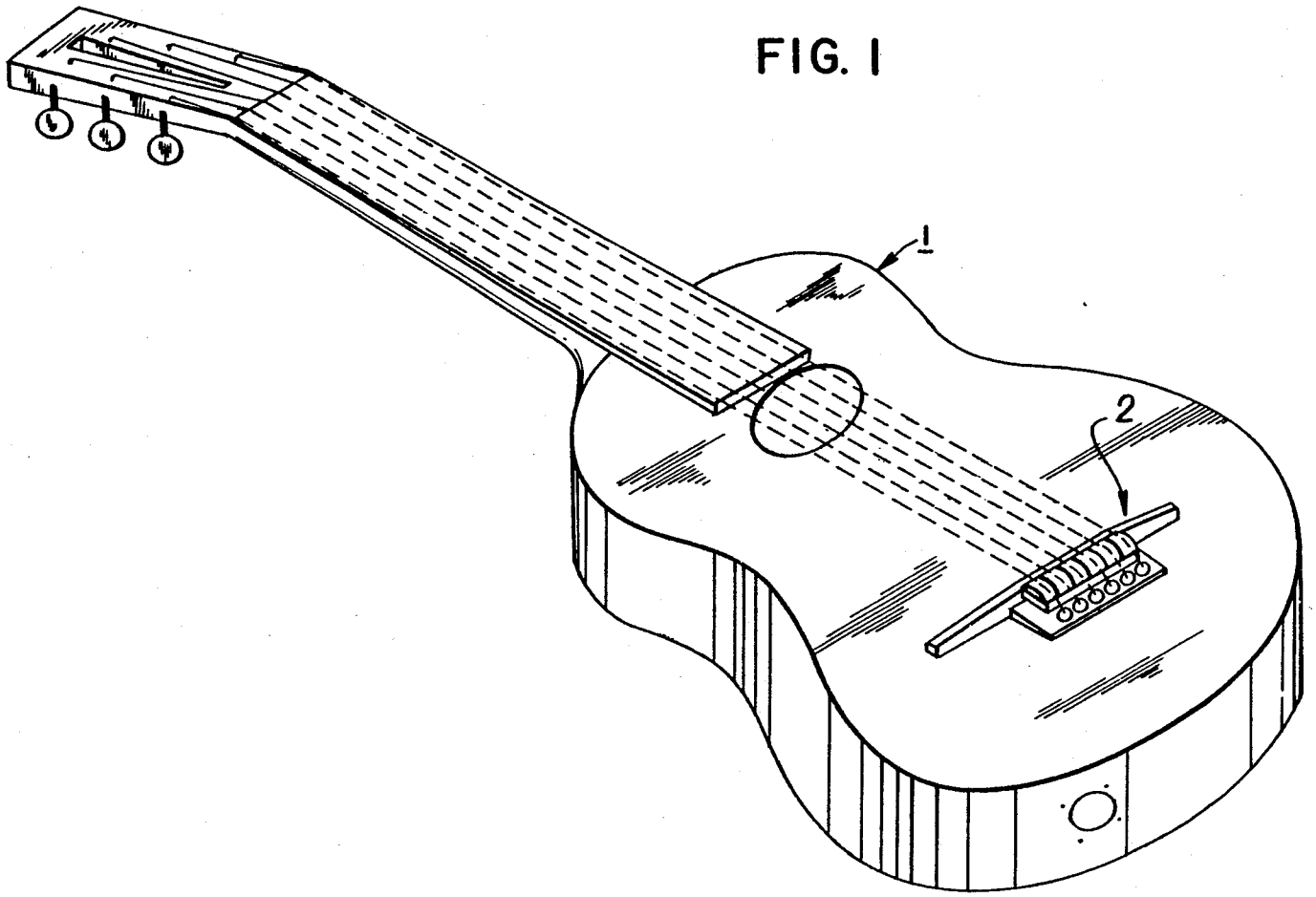
FIG. 1 is a perspective view of an embodiment of the invention.

Referring to the figures—FIG. 1 shows a guitar 1, having a bridge 2, according to the invention.

Figure 2:
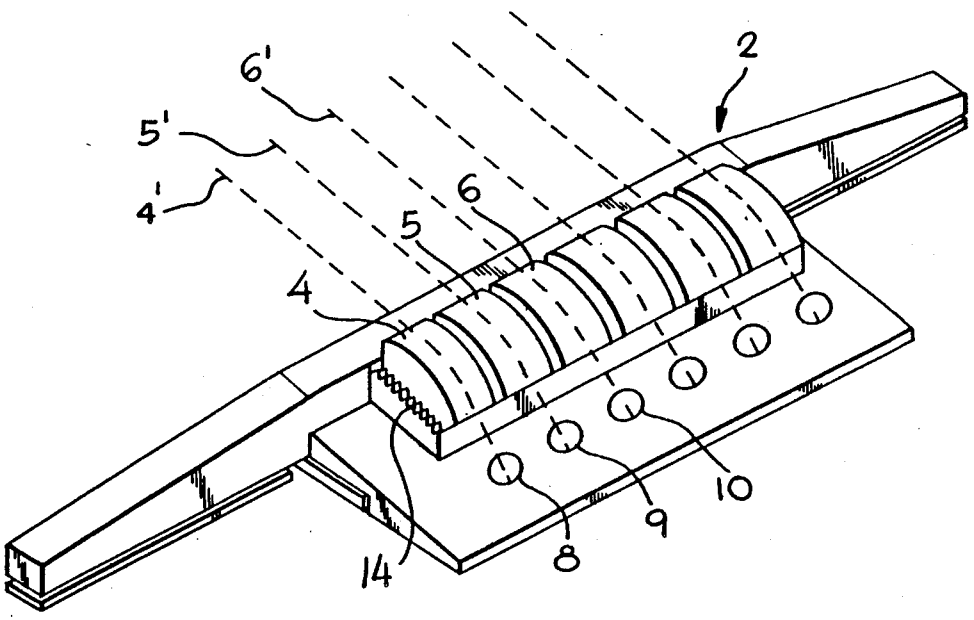
FIG. 2 is an enlarged perspective view of the bridge.

FIG. 2 shows a perspective view of a bridge 3 having individual saddle members 4,5,6, etc. Each individual saddle member is preferably grooved to accommodate one string, 4', 5', 6', etc. Interlocking teeth members 7 serve for connection between upper and lower saddle members. The interlocking teeth are of saw tooth shape as shown in FIGS. 2, 4A and 4B. The strings are led through the holes 8, 9, 10, etc. and are led underneath the sound board and anchored below the sound board, in a manner which is not shown in this figure. This embodiment provides string length fine tuning by adjustment of the upper saddle members on the lower saddle members.

FIG. 3 shows a modification similar to FIG. 2, wherein the base B has a notch 10 in which is inserted a wedge 11 for the purpose of adjusting the rigidity of base B, and also separating the push-pull mechanism by which the tension in the strings is applied to the body of the guitar. The individual saddle members 4*a*, 5*a*, 6*a* are similar to those in FIG. 2. These saddles are set against the base at a 90° angle by which the tension in the strings are resolved into horizontal and vertical pressure forces on the base B.

FIG. 4 shows front, top and side views of various modifications of saddle members 12, 13, 14,15, 16 and 17.

FIG. 4A shows a base saddle piece 18, together with an upper additional piece 19. The upper saddle pieces may vary in shape as illustrated in FIG. 4B, depending upon the effect desired. By varying the longitudinal position of the upper saddle pieces 19 on the base saddle piece 18, the string length is varied to achieve string length fine tuning. Of interest in FIG. 4b are the upper saddle pieces formed with peaks located between the front and rear surfaces of the upper saddle pieces.

FIG. 5 shows side views, illustrating the forces developed between the base 20, 21, 22 and saddle pieces 23, 24 and 25. By changing the configuration of the upper saddle pieces 23, 24 and 25 various forces shown by the arrows may be obtained. The srings 26 are anchored to the sound board by means of the member 28. By changing the shapes of the upper and lower saddle members, forces may be developed in different directions. Horizontal as well as vertical pressure is exerted against the bases of the bridge. In FIG. 5, Point B has a maximum height away from Point C without string buzz. In FIG. 5A the distance between Point D and Point A has been enlarged and more vertical pressure is exerted. In FIG. 5B the distance between the Point D and Point C is enlarged and more horizontal pressure is exerted. The rear surface of the saddle piece 25 is shaped to direct the string to anchor member 28 substantially perpendicularly to the sound board. The angle of the bridge base in FIGS. 5, 5A and 5B causes a horizontal force to have a downward vertical component or pressure on the base.

Figure 6:
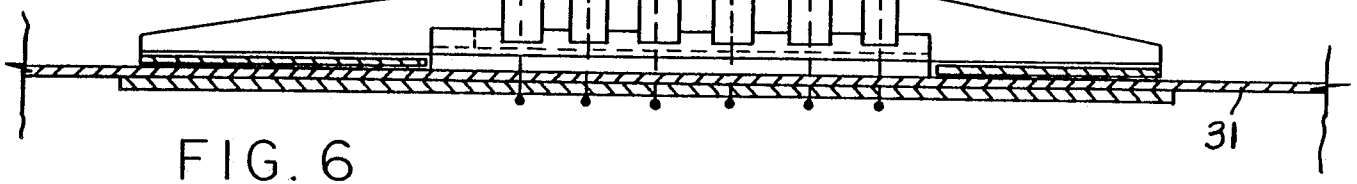
FIG. 6 is a rear view of the bridge.

FIG. 6 shows a partially sectional view of the bridge 30 mounted on a sound board 31.

Figure 7:
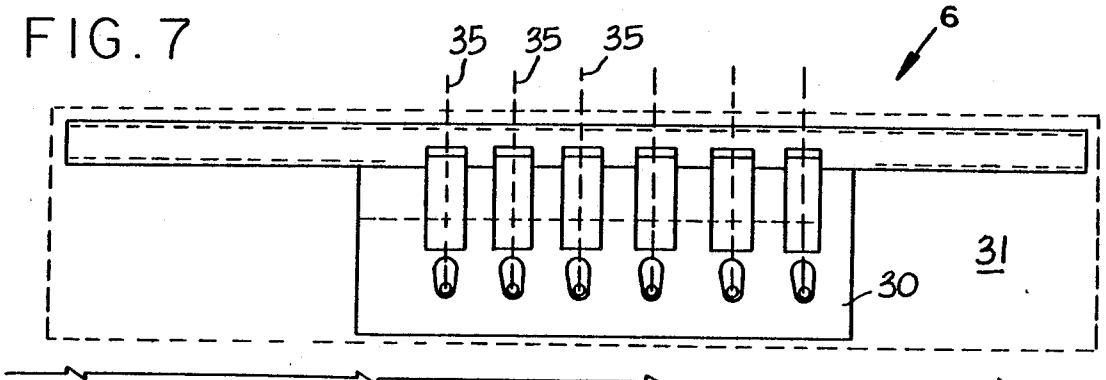
FIG. 7 is a top view of FIG. 6.
Figure 7A:
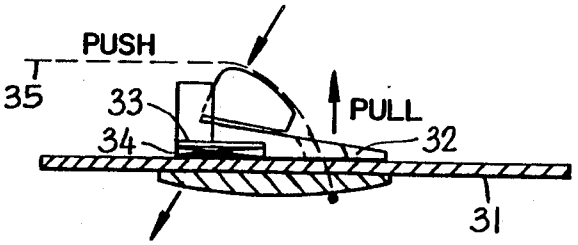
FIG. 7A is a side view of FIG. 7.

FIG. 7 shows a top view of FIG. 6 and FIG. 7A shows a side view of FIG. 7, showing the bridge mounted on the sound board 31. The base 32 of the bridge has a notch 33 in which is inserted a wedge 34 to adjust and lock the position of the bridge and tension on the string 35. It also serves to separate the push-pull mechanism.

Figure 8:
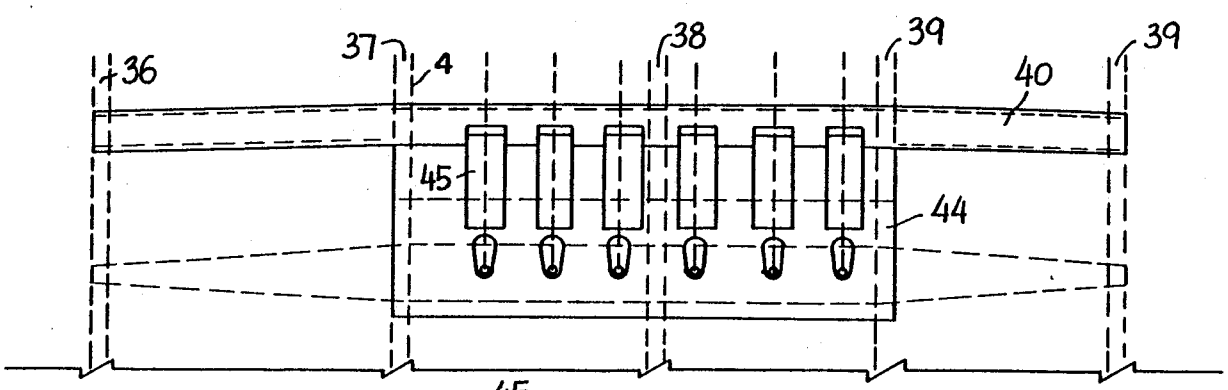
FIG. 8 is a detailed view illustrating the undersurface bracing for the bridge, in conjunction with fan bracing, now in existance.
Figure 10:
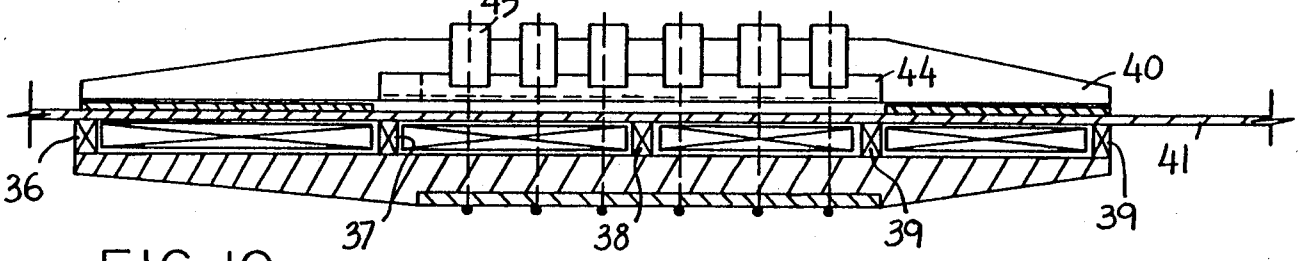
FIG. 10 is a partially sectional view of FIG. 8.
Figure 9:
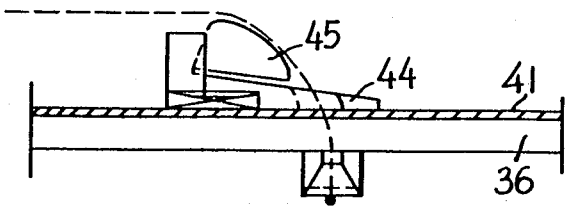
FIG. 9 is a side view of FIG. 8.

FIGS. 8, 9 and 10 show an undersurface structure having solid members 36, 37, 38 and 39 which extend longitudinally in transverse spaced relation and reinforce the bridge member 40 and a transverse cross bar secured on members 36–39 and to which the strings are attached. The base structure is mounted under the sound board 41, upon which is mounted the bridge 40. FIG. 8 is a top view of FIG. 10 and FIG. 9 is a side view of FIG. 8, showing the bridge member 40, comprising a base 44, and a saddle 45. This is an example of the fan bracing. The saddles may be of ivory or graphite.

As evident from the figures of the drawing, the base has a front upstanding wall, forming with the base an L-shaped cross-section (FIG. 3), against which the saddle abuts under the tension in the strings, the upper surface of the saddle being extended to provide spaced front and rear edges (point A and point B respectively) at which the strings come into contact with and leave the saddle, the front surface of the saddle abutting against the upstanding wall of the base while the rear surface of the saddle (at points B and C) is free from contact. The interengagement of the upper and lower saddle pieces allows adjustment of the upper saddle pieces between fixed adjusted longitudinal positions to effect string length fine tuning.

It is claimed:

1. In a stringed musical instrument having a resonating box, a sound board on the resonating box, a plurality of strings extending over the sound board, said strings defining a longitudinal direction between a bridge on which the strings pass in stretched condition and tuning means remote from the bridge for varying the tension in the strings; an improvement according to which said bridge comprises:

a base on the sound board, a saddle on the base;

means for attaching the strings to the sound board in spaced relation from said saddle;

said saddle having an upper surface elevated above said base and positioned so that the tensioned strings pass thereon and apply force to the saddle to press the saddle against the base and to urge the saddle longitudinally towards the tuning means, said upper surface of said saddle having spaced front and rear edges at which the strings respectively come into contact with and leave the saddle;

said base having an upstanding wall against which the saddle abuts under the tension in the strings, said upstanding wall extending transverse said longitudinal direction such that a cross-section of said base taken along said longitudinal direction is generally L-shaped, said base further having a lower surface with a transverse notch therein opening toward said tuning means, and a wedge member mounted in said notch; and said saddle having a front surface which abuts against said upstanding wall and a rear surface which is free and over which the strings pass to the string attaching means.

2. The musical instrument as in claim 1 wherein said saddle comprises a plurality of adjoining saddle members, one for each string.

3. The musical instrument as in claim 1 wherein said base has a surface on which said saddle is engaged, said surface of said base forming an angle with the sound board.

4. The musical instrument as in claim wherein said saddle includes a first saddle portion supported on said base and abutting against said upstanding wall thereof, a second saddle portion supported on said first saddle portion, and interengaging surfaces on said first and second saddle portions which enable the second saddle portion to be adjusted in longitudinal position on the first saddle portion and to be fixed thereon in the adjusted longitudinal position.

5. The musical instrument as in claim 4 wherein said interengaging surfaces on said first and second saddle portions include interlocking teeth.

6. The musical instrument as in claim 5 wherein said interlocking teeth are of saw tooth shape.

7. The musical instrument as in claim 4 wherein said upper surface of said second saddle portion includes a peak intermediate the ends of the second saddle portion.

8. The musical instrument as in claim 1 wherein said upper surface of the saddle is curved.

9. the musical instrument as in claim 1 wherein said means for attaching the strings to the sound board comprises an underface structure mounted under said sound board, the sound board being apertured to permit the strings to pass into the reasoning box and be secured to the underface structure whereby the strings may directly vibrate the sound board.

10. The musical instrument as in claim 9 wherein said underface structure comprises a plurality of longitudinal members secured to the underside of the sound board and disposed in transversely spaced relation below the bridge, and a cross bar extending below and transversely of the longitudinal members, said cross bar being secured to the longitudinal support members, said strings being secured to said cross bar.

11. A string musical instrument comprising a resonating box, a sound board on the resonating box, a plurality of strings extending over the sound board, a bridge on which the strings pass in stretched condition, and tuning means remote from the bridge for varying the tension in the strings, said bridge comprising a base on the sound board, a saddle on the base, means for attaching the strings to the sound board in spaced relation from said saddle, said saddle having an upper surface elevated above said base and positioned so that the tensioned strings pass thereon the apply force to the saddle to press the saddle against the base, said base having an upstanding wall against which the saddle abuts, said saddle having a front surface which abuts against said upstanding wall and a rear surface which is free and over which the strings pass to the string attaching means; said base having a lower forward surface with a transverse notch therein forming a space with said base, and wedge means mounted in said space for producing increased volume and sustain, when the strings are vibrated, due to the forces applied to the sound board by said base and said wedge means.

12. The musical instrument as in claim 11 wherein said base has a surface on which said saddle is engaged, said surface of said base forming an angle with the sound board.

13. A stringed musical instrument as claimed in claim 11 wherein said rear surface of said saddle is shaped to direct the string to the string attaching means substantially perpendicular to the sound board.

14. The musical instrument as in claim 11 including an underface structure comprising a plurality of longitudinal members secured to the underside of the sound board and disposed in transversely spaced relation below the bridge, and a cross bar extending below and transversely of the longitudinal members, said cross bar being secured to the longitudinal support members, said strings being secured to said cross bar.

* * * * *